United States Patent [19]

Bush

[11] 4,422,637

[45] Dec. 27, 1983

[54] POOL BALL HOLDER AND SPOTTING DEVICE

[76] Inventor: Edward A. Bush, 2407 Blossom Ct., Ft. Pierce, Fla. 33450

[21] Appl. No.: 346,550

[22] Filed: Feb. 8, 1982

[51] Int. Cl.[3] ..... A63D 15/00

[52] U.S. Cl. ..... 273/22

[58] Field of Search ..... 273/22, 26 R, 201

[56] References Cited

U.S. PATENT DOCUMENTS

| | | | |
|---|---|---|---|
| 479,213 | 7/1892 | Fuchs | 273/22 X |
| 1,246,436 | 11/1917 | Kitzeman | 273/22 |
| 1,940,321 | 12/1933 | Pagett | 273/201 |
| 2,071,356 | 2/1937 | Pagett | 273/201 |
| 4,146,232 | 3/1979 | Stone | 273/201 |

FOREIGN PATENT DOCUMENTS

| | | | |
|---|---|---|---|
| 1110564 | 4/1968 | United Kingdom | 273/201 |

*Primary Examiner*—Richard J. Apley
*Attorney, Agent, or Firm*—Malin & Haley

[57] ABSTRACT

A storage and dispensing device for billiard balls or pool balls that includes a pivotable off-loading arm that positions the balls at a plurality of desired positions on a billiard table or pool table for subsequent play. The storage and dispensing device, operable by hand or from virtually any position around a billiard or pool table with the added reach of a cue stick, spots the balls at various desired locations. The device includes a gravity operated sequential ball storage ramp, a base connected below the ramp that is connectable to the edge of the playing table, and an off loading arm that is pivotally connected at the lower end of the storage ramp. The off-loading arm is pivotally movable about an axis which is parallel to the playing surface, movable from an upper rest position wherein the distal end of the arm is above the table surface and is higher than the arm pivot axis at the proximal end of the arm, to a lower in-use position, wherein the distal end rests on the table surface and is lower than the arm's proximal end. Each time the off-loading arm is so cycled from and back to the rest position, one ball is placed at a desired location on the table. A biasing means returns the arm to its upper rest position. The off-loading arm is also rotatable in arcuate fashion over the table about the vertical axis of the device, which is perpendicular to the table to which the device is attached, so that the balls may be deposited at one of a plurality of positions on the table. The off-loading arm may be made to telescope longitudinally to provide further versatility in positioning the balls on the table. A handle may also be provided for carrying.

8 Claims, 7 Drawing Figures

Position B.
Position A
60
24
22
23
14
21
20
10
12
16
28
26
18
31
32
30
54
36
34
38
110
50
44
42
71a
71b
72
76
71c
82, 83
78
74
94
70
100b
100
90, 91
86, 87
88, 89
80
92
84, 85
40
46
2
D
S

POOL BALL HOLDER AND SPOTTING DEVICE

BACKGROUND OF THE INVENTION

In the past a plurality of devices have been used to allow the movement of spherical objects to sequentially move them from a storage platform. Such devices have been utilized for depositing golf balls to a particular location from which someone may thereafter hit the golf balls for practice purposes. The present invention is a device related to storing or holding billiard or pool balls that also has a movable off-loading arm so that the pool balls may be positioned at a plurality of positions on the pool table or billiard table.

BRIEF DESCRIPTION OF THE INVENTION

A storage and dispensing device for depositing sequentially stored billiard or pool table balls onto a billiard or pool table to be thereafter put into play. This device places only one ball onto the playing surface each time an off-loading arm is arcuately pivoted downward from its normally upward stored position. This upward storing position of the off-loading arm is maintained by a biasing means interconnected between the rack and the arm. The off-loading arm, pivotally attached at its proximal end to the lower end of the gravity fed ball storage rack, may also be rotated in arcuate fashion about the rotational axis of the base of this device which is generally perpendicular to the plane of the table to which the base is attached. This rotation allows deposit of the stored balls, one at a time, onto a plurality of positions on the playing surface along the arc struck by the distal end of the off-loading arm. This device is readily attachable along the edge of a billiard or pool table to provide for further variety of ball placement positions.

An alternate embodiment of the off-loading arm is one which telescopes longitudinally, thus varying the length of the arm and thusly, also yet further increasing the range of ball positions available.

The distal end of the off-loading arm may be brought downward from its rest positions by manual pivoting by hand contact, or more remotely, by contact with a cue stick.

It is an object of this invention to provide a means for storing billiard or pool balls on a rack attachable to the edge of a billiard or pool table.

It is another object of this invention to provide a means for placing billiard or pool balls stored in a rack onto a billiard or pool table, positioned per the player's choice.

It is yet another object of this invention to provide a means for placing billiard or pool balls in a rack onto a billiard or pool table in arcuate fashion along an arc struck by the distal end of a pivotal off-loading arm attached to the storage rack.

It is still another object of this invention to provide an optional means for increasing the range of ball placement by providing a telescoping off-loading arm.

In accordance with these and other objects which will be apparent hereafter, the instant invention will now be described with particular reference to the accompanying drawings.

PREFERRED EMBODIMENT OF THE INVENTION

Figures 1, 2, 3, 7:
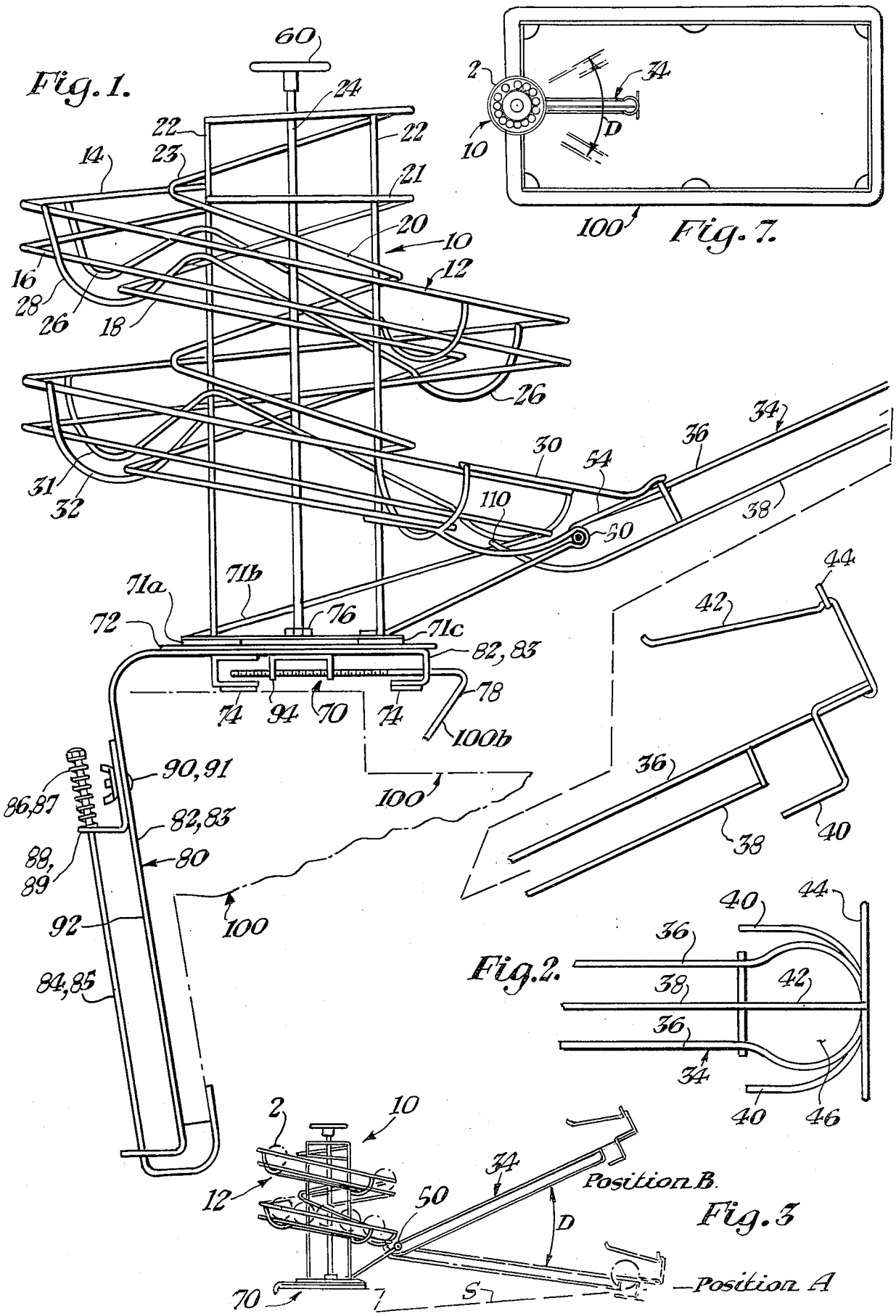
FIG. 1 is a side elevation view of the entire invention showing the interrelationship to the edge of a billiard or pool table (in phantom).
FIG. 2 is a plan view of the distal end of the off-loading arm.
FIG. 3 is a less detailed side elevation view of the entire invention showing the pivotal positions of the off-loading arm.
FIG. 7 is a plan view of the entire invention shown attached to the end edge of a billiard or pool table.

Referring now to the drawings, and particularly to FIG. 1, the present invention 10 comprises a spiral-shaped sequential ball storage rack or ramp 12, a base 70 to which the rack 12 is rotationally connected, an off-loading arm 34 pivotally connected at 50 to the rack, and an attaching means 80 for removably attaching this invention to the edge of a billiard or pool table.

The rack 12 is generally fabricated of formed wires or rods fastened at appropriate contact points by soldering, welding, mechanical fasteners, or the like. Alternately molded plastic could be employed to fabricate one or more of the elements thereto. The rack includes a vertical support structure of parallel members 22 held in position and connected to a helix-wound member 21. A plurality of additional helix-wound members 14, 16 and 18 form the spiral ramp which holds the balls and feeds them, aided by gravity, down the ramp to the off-loading arm 34. These ball support members 14, 16 and 18 are held in proper position to both support and allow free rolling of the stored balls by a plurality of transverse support members 26, 28, 31 and 32. These transverse support members are interconnected between the vertical support structure and the helix-wound spiral ramp members 14, 16 and 18.

Figure 5:
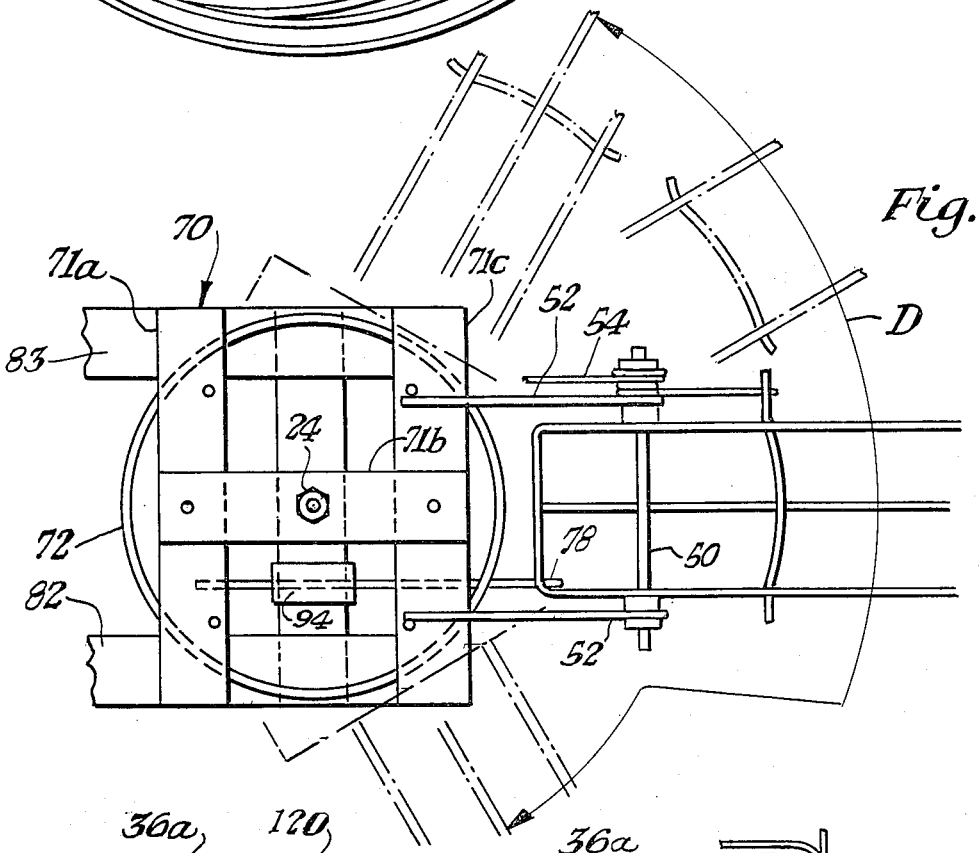
FIG. 5 is a plan view of the base (rack removed) showing the range of rotational positions of the off-loading arm.

The rack 12 is connected to the upper base members 71*a* and 71*c* of base 70, also shown in FIG. 5. Base 70 also includes an intermediate glide ring 72 interconnected between horizontal portions of lower members 82 and 83. The upper base members 71*a* and 71*c* rotatably engage glide ring 72, this rotation occurring about the vertical axis of interconnecting shaft 24. In addition to maintaining the physical relationship and alignment between the upper base members and the intermediate glide ring 72, the threaded lower end of shaft 24, having an integral collar 76 thereon, serves to adjust friction pressure between these members by appropriate rotation of handle 60 connected to shaft 24, thereby regulating rotational stability of the rack and attached off-loading arm.

Base lower members 82 and 83 serve as part of the removable table edge attaching means 80. The vertical lower portions of members 82 and 83 press against the vertical surface 92 of the table edge as the entire device is mounted onto the table. Spring-loaded table edge board clamps 84 and 85, upwardly biased by springs 86 and 87, serve to restrain members 82 and 83 in position against the table edge by releasable engagement against the lower vertical surface 92 of the table edge. The final portion of the table attaching means is a threadably adjustable bumper engaging member 78, threadably connected to the lower portion of the base by bracket 94. (See FIG. 5 also.) The bumper engaging member 78 is formed to mateably engage the table bumper contour 100*b*, and can be positioned in bracket 94 to accommodate virtually any billiard or pool table. Pads 74 are provided to prevent scratching or abrasion of the table edge as this device is attached thereto.

The off-loading arm 34 is shown in FIGS. 1 and 2, and generally includes a longitudinal ramp member for conveying the stored balls from the proximal end to the distal end of the arm, said ramp formed by rods 36 and 38. The distal end of arm 34 has an opening 46 formed by rod 36 sufficiently large to allow a ball to drop therethrough. Feet 40 serve as a lower stop as they contact the table surface. Arm positioning brackets 42 and 44 are provided to be used as a handle if the arm is pivoted by hand contact, or serve as striker bars when contacted by cue stick.

Figure 4:
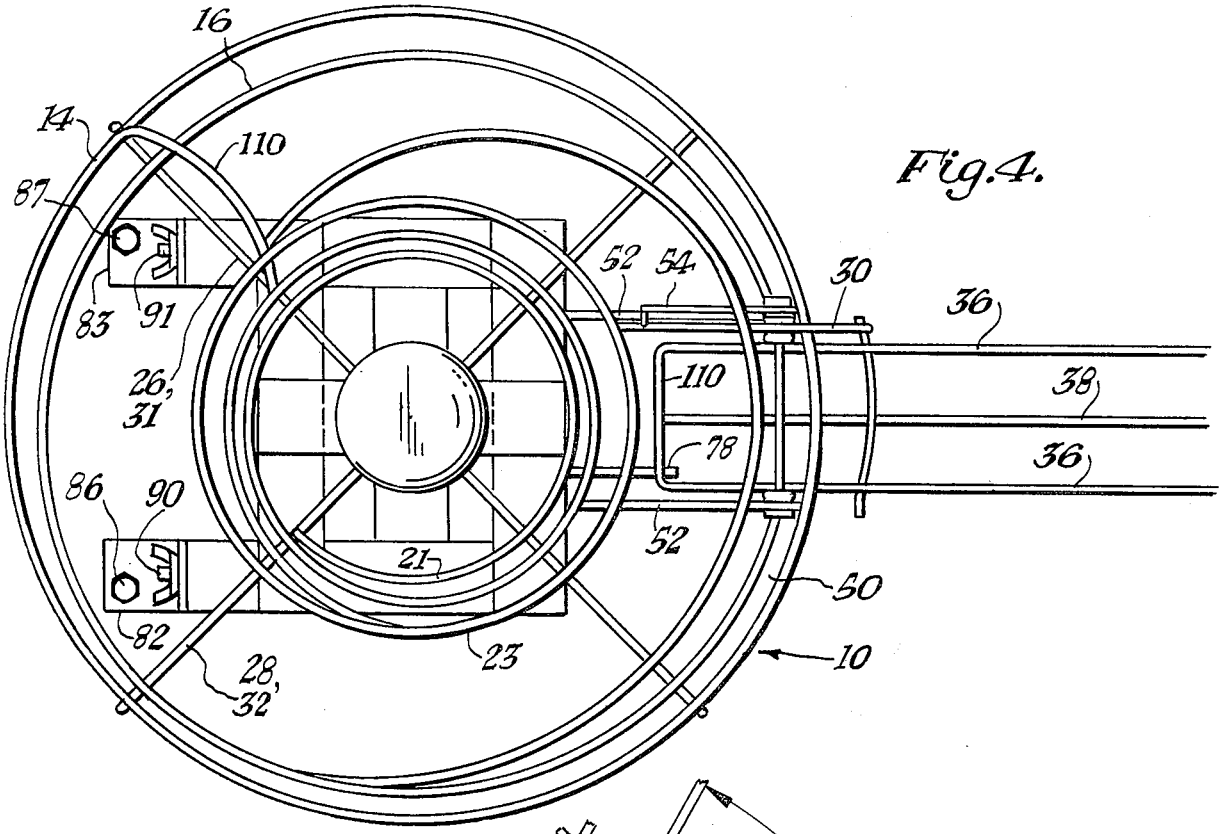
FIG. 4 is a detailed plan view of the storage rack and the proximal end of the off-loading arm.

FIG. 3 shows rack 12 loaded with balls 2, arranged in a sequence chosen by the player. The off-loading arm 34 is pivotable about pivot shaft 50 from a stored position B, temporarily, to an in-use position A, where one ball at a time is deposited onto the table surface S. As can be seen in FIGS. 1 and 4, as the off-loading arm 34 is pivoted about shaft 50 into position A (FIG. 3), a ball stop 110, integral to arm 34, also pivots upwardly to prevent the next ball from entering the off-loading arm. The ball that has previously entered the proximal end of arm 34 is allowed to roll to the distal end of arm 34 when the arm is placed in position A (FIG. 3). Feet 40, shown also in FIGS. 1 and 2, properly position the distal end of arm 34 against the table surface so that the ball which has rolled to this end of the arm drops through the relatively larger opening 46. Biasing means 30 communicates between the rack and the off-loading arm to return the off-loading arm to its rest position B.

Figure 6:
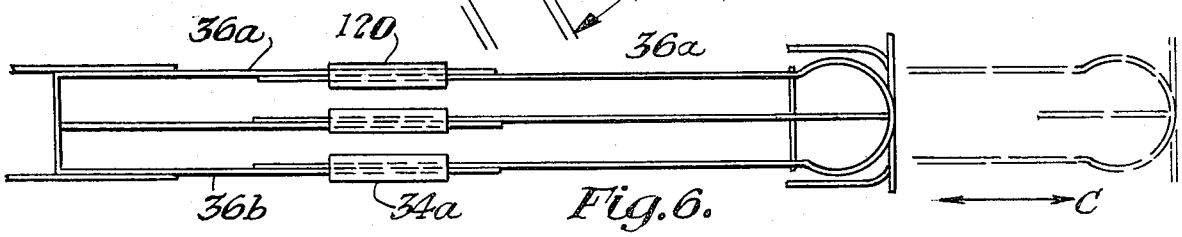
FIG. 6 is a plan view of the alternate telescoping off-loading arm.

FIG. 5 details the swivel base 70, discussed above, allowing the player to rotate the rack and off-loading arm through arc D (also shown in FIG. 7) to provide a broad arcuate sweep of the distal end of the off-loading arm. To further extend the range of ball placement positions available to the player, a telescoping off-loading arm 34*a* in FIG. 6 may be provided. The distal end of the arm is longitudinally movable in direction C to provide this feature. Connecting means 120, which is a part of the telescoping means, is designed so as not to interfere with the smooth downward roll of each ball.

The instant invention has been shown and described herein in what is considered to be the most practical and preferred embodiments. It is recognized, however, that departures may be made therefrom within the scope of the invention and that obvious modifications may occur to a person skilled in the art.

What I claim is:

1. A device for storing and sequentially dispensing billard or pool balls onto the playing surface of a billiard or pool table comprising:

a means for holding and storing the balls in a sequence selected by the player;

a means for removably attaching said holding means onto the edge of the table;

a means for placing one ball at a time onto the playing surface in a position selected by the player, said placing means having a proximal and a distal end;

a means for rotating said placing means in arcuate fashion, said rotation means for increasing the range of available ball placement by the player;

said attaching means interconnected between the lower end of said holding and storing means and said rotating means;

a biasing means for holding said distal end of said placing means above the playing surface when not in use;

said holding and storing means aided by gravity to deliver the balls to said placing means;

said placing means pivotally connected to said holding and storing means at said proximal end of said placing means;

said placing means pivotable about said pivot connection by the player by manual arcuate movement of said distal end of said placing means downwardly to the table surface;

said ball placement determined by the position of said distal end selected by the player.

2. A device for storing and holding balls as defined in claim 1, further comprising:

a means for telescopically varying the length of said placing means;

said telescoping means for further increasing the range of available ball placement positions.

3. A device for storing and holding balls as defined in claim 1 further comprising a carrying handle.

4. A device for storing and holding balls as defined in claim 3, further comprising:

a means for adjusting resistance to said rotation means thereby regulating rotational stability of said placing means;

said adjusting means connected to said handle.

5. A device for storing and sequentially dispensing billiard or pool balls onto the playing surface of a billiard or pool table comprising:

a spiral shaped rack having an upper end and a lower end for holding and storing the balls in a sequence selected by the player, the balls that are placed onto said upper end being rollably delivered by gravity feed to said lower end;

a base having an upper portion and a lower portion, said upper portion attached beneath said rack, said upper and said lower portions rotatably interconnected;

said lower portion of said base including means for removably attaching said base to the edge of the table;

an off-loading arm having a proximal end and a distal end, said proximal end pivotally connected to said lower end of said rack, and;

a biasing means interconnected between said proximal end of said off-loading arm and said lower end of said rack, said biasing means for maintaining said distal end of said arm above the playing surface when said arm is not in use;

said arm for positioning balls delivered to said lower end of said rack, one at a time, onto the playing surface each time the player, by mechanical actuation, lowers said distal end of said arm downwardly to the table surface;

said arm including means at said proximal end for allowing only one ball to be delivered to said distal end each time said distal end is manually moved downwardly to contact the playing surface by the player.

6. A device for storing and sequencially delivering balls as defined in claim 5 wherein said arm further includes:

a means for varying the length of said arm;

said means for varying said length of said arm for increasing the range of ball placement positions available to the player.

7. A device for storing and sequentially dispensing billiard or pool balls onto the playing surface of a billiard or pool table as defined in claim 5, further comprising a carrying handle connected to said base.

8. A device for storing and sequentially dispensing billiard or pool balls as defined in claim 7, further comprising:

a means for adjusting friction pressure between said base upper portion and said base lower portion;

said friction adjusting means for regulating rotational stability of said off-loading arm;

said friction adjusting means connected to said handle.

* * * * *